US006494019B1

(12) United States Patent
Lingle

(10) Patent No.: US 6,494,019 B1
(45) Date of Patent: Dec. 17, 2002

(54) HIGH SPEED ENVELOPE INSERTER

(76) Inventor: Jeffrey A. Lingle, 228 N. Charles St., Waukesha, WI (US) 53186

( * ) Notice: Subject to any disclaimer, the term of this patent is extended or adjusted under 35 U.S.C. 154(b) by 0 days.

(21) Appl. No.: 09/510,762

(22) Filed: Feb. 22, 2000

(51) Int. Cl.[7] ..... B65B 5/00

(52) U.S. Cl. ..... 53/247; 53/250; 53/251; 53/259; 53/284.3; 53/381.6; 53/381.7; 414/797.4; 414/797.8

(58) Field of Search ..... 53/381.7, 250, 53/284.3, 251, 259, 381.6, 540, 569, 247; 414/797.4, 797.8

(56) References Cited

U.S. PATENT DOCUMENTS

| | | | | |
|---|---|---|---|---|
| 3,116,718 A | | 1/1964 | Krupotich et al. | 120/35 |
| 3,726,454 A | | 4/1973 | Robbins | 255/99 |
| 3,965,644 A | | 6/1976 | Stocker | 53/29 |
| 4,016,708 A | | 4/1977 | DeHart | 53/381 |
| 4,020,615 A | | 5/1977 | Irvine et al. | 53/35 |
| 4,169,341 A | | 10/1979 | Roetter et al. | 53/154 |
| 4,305,691 A | * | 12/1981 | Mayer | 414/797.8 |
| 4,630,812 A | * | 12/1986 | Yano et al. | 414/797.8 |
| 4,699,371 A | * | 10/1987 | Ettischer et al. | 414/797.4 |
| 4,715,164 A | | 12/1987 | Luperti et al. | 53/381 |
| 4,813,209 A | * | 3/1989 | Foster et al. | 53/284.3 |
| 4,888,938 A | | 12/1989 | Auerbach | 53/569 |
| 4,922,689 A | | 5/1990 | Haas et al. | 53/569 |
| 4,926,612 A | | 5/1990 | Krasuski et al. | 53/69 |
| 5,150,891 A | | 9/1992 | Svyatsky et al. | 271/35 |
| 5,191,751 A | * | 3/1993 | Marzullo et al. | 53/381.7 |
| 5,247,780 A | | 9/1993 | Kulpa et al. | 53/381.5 |
| 5,415,068 A | | 5/1995 | Marzullo | 53/492 |
| 5,467,577 A | * | 11/1995 | Sato | 53/284.3 |
| 5,524,417 A | | 6/1996 | Iddon | 53/381.7 |
| 5,581,972 A | * | 12/1996 | Antonelli | 53/284.3 |
| 5,618,375 A | | 4/1997 | Suzuki et al. | 156/442.3 |
| 5,626,001 A | | 5/1997 | Belec | 53/284.3 |
| 5,630,312 A | | 5/1997 | Ballard et al. | 53/569 |
| 5,675,959 A | | 10/1997 | Hamma et al. | 53/381.1 |
| 5,722,221 A | | 3/1998 | Matlman et al. | 53/493 |
| 5,729,954 A | | 3/1998 | Lines et al. | 53/381.7 |
| 5,924,265 A | * | 7/1999 | Auerbach | 53/381.6 |
| 5,950,399 A | * | 9/1999 | Viens et al. | 53/284.3 |
| 5,971,385 A | * | 10/1999 | Belec | 53/381.7 |
| 6,164,046 A | * | 12/2000 | Werner et al. | 53/284.3 |

* cited by examiner

*Primary Examiner*—John Sipos
*Assistant Examiner*—Louis Huynh
(74) *Attorney, Agent, or Firm*—Andrus, Sceales, Starke & Sawall, LLP

(57) ABSTRACT

A system for the automated insertion of documents into envelopes. The system includes a plurality of individual document feeding devices that feed individual documents from an assembled stack onto a moving document conveyor. Each of the document feeding devices includes a suction device that pulls the lowermost document into contact with a discharge nip formed between a pair of opposed rotating belts. After being deposited onto the document conveyor, each of the documents enters into a pusher assembly in which each of the documents is accelerated and pushed into an open envelope positioned adjacent to the discharge end of the document conveyor. The stack of opened envelopes is fed by the combination of an envelope feeding device and an envelope conveyor section. The envelope feeding device receives a stack of closed envelopes and feeds and opens each envelope before it is stacked adjacent to the discharge of the document conveyor.

9 Claims, 4 Drawing Sheets

HIGH SPEED ENVELOPE INSERTER

BACKGROUND OF THE INVENTION

The present invention generally relates to the unloading of documents from a stack or stacks and the subsequent insertion of such documents into envelopes. More specifically, the present invention relates to an automated system that discharges a single document or several documents onto to a discharge conveyor and loads the documents into an open envelope while maintaining the required control over the documents to reduce mishandling.

Currently, many systems exist for the automated insertion of documents into envelopes and the subsequent processing of the envelopes for automated mailing. For envelope insertion operations, it is generally necessary to provide a stack of envelopes which have had the envelope flap opened so that the materials to be inserted may be inserted therein. In typical prior art systems, such as shown in U.S. Pat. Nos. 4,020,615; 4,888,938; and 5,247,780, opening fingers or blades are inserted into the envelope to allow documents or articles to be slid into the opened envelope.

An inherent drawback in envelope inserting systems that includes blades or fingers to open the envelopes is that at higher speeds, the blades or fingers that come into contact with the envelope will tear or otherwise damage the envelope, thereby resulting in system shutdowns and delays. Additionally, high speed operation requires the mechanical fingers to continuously operate, which results in wear and mechanical breakdowns.

Along with the inherent problems that result from the use of insertion fingers or blades is the lack of control over the product as it moves at high speeds throughout the system. A primary reason for the lack of control of articles being inserted into the envelopes is the continual starting and stopping of both the articles and the envelopes throughout the entire production process. Additionally, in many currently available machines and systems, both the documents and envelopes change directions several times during the insertion process. During each of the direction changes, the articles and envelopes suffer from a lack of control which tends to restrict the speed of the production process.

An additional problem with currently available systems running at higher speeds is the deterioration of the gears and cams that are used to operate the unloading devices and the devices used to insert the documents into envelopes. Therefore, a need currently exists for an improved system for the automated insertion of documents and other articles into envelopes that maintains the required control over the documents and envelopes to allow for the high speed stuffing of envelopes. Further, it is an object of the present invention to provide a system that maintains the required amount of control over the articles as the individual articles move in a single direction from accumulated stacks of documents to finally being placed within the desired envelope. Further, it is an object of the present invention to provide an outfeed conveyor assembly that allows multiple envelope insertion lines to be accumulated on a common conveyor system.

SUMMARY OF THE INVENTION

The present invention is a system for the high speed and automated insertion of documents into envelopes. The system operates to maintain control over the documents throughout the process and operates in a single, first direction such that the envelopes and documents do not change direction.

The envelope inserter of the present invention includes a document conveyor that extends in a first direction. The document conveyor terminates at a discharge end and includes an endless drive chain having a plurality of tabs. Each of the tabs are spaced along the length of the drive chain and function to engage and move the documents along the length of the document conveyor.

The envelope inserter further includes a plurality of individual document feeding devices spaced along the length of the document conveyor. Each of the document feeding devices includes a stacking bin that receives a stack of documents to be dispensed. The stack of documents contained within the stacking bin can be folded or flat documents, depending upon the type of material to be inserted into the envelopes.

Each of the document feeding devices includes a suction device positioned beneath the bottom end of the stacking bin and is operable to remove the lowermost document from the accumulated stack. The suction device includes a suction cup and support arm that are movable between a grasping position, a discharge position, and a retracted position. When the suction device is in the grasping position, a source of negative air pressure is applied to the lowermost document through a suction cup contained on the suction device. After the supply of negative air pressure is applied to the lowermost document, the suction device can be moved to the discharge position to pull the lowermost document out of the accumulated stack in the stacking bin.

As the suction device pulls the lowermost document from the accumulated stack, the document is pulled into contact with a discharge nip formed between a pair of rotating discharge belts. The discharge belts are operated at substantially the same speed such that when the document enters into the discharge nip and the supply of negative air pressure is removed, the pair of rotating discharge belts act to direct the document onto the document conveyor. One of the discharge belts passes around a drive member that is operable to adjust the position of the discharge nip. Specifically, the drive member operates to move the discharge nip upward to pull the document from the suction device when the suction device is in the discharge position. As the discharge belts engage the document, the suction device moves to the fully retracted position that is completely out of the way of the document as it is pulled from the stack. The operation of each document feeding device is controlled by a control unit that times the discharge of each document such that each document is positioned in contact with one of the moving tabs on the document conveyor.

As the discharged documents are moved along the document conveyor, the discharged documents pass beneath a document insertion device. The document insertion device is positioned near the discharge end of the document conveyor and operates to act upon the documents as the documents approach the discharge end of the document conveyor. The document insertion device includes a continuous belt that operates in-line with the document conveyor in the first direction.

The continuous belt of the document insertion device includes a plurality of pusher members that contact the individual documents supported along the document conveyor. Each of the pusher members contacts the document and pushes the document off of the discharge end of the document conveyor and onto a support platform. The endless belt of the document insertion device is operated at a speed slightly faster than the speed of the document conveyor such that the documents are accelerated by the pusher members of the document insertion device.

A stacking device that includes a stack of opened envelopes is positioned immediately adjacent to the discharge end of the document insertion device such that the pusher members of the document insertion device push the documents into the uppermost envelope of the opened envelope stack. A blast of air is directed into the uppermost envelope of the opened envelope stack to open the envelope prior to insertion of the document by the document insertion device.

The stack of opened envelopes in the stacking device is created by the combination of an envelope feeding device and an envelope conveyor. The envelope feeding device is generally identical to the plurality of document feeding devices and thus includes a stacking bin including a supply of unopened envelopes. The unopened envelopes contained within the stack in the storage bin are fed individually into a discharge nip by a suction device. As the unopened envelopes are fed from the stack, a powerful air blast is used to open the envelope flap prior to the envelope entering into the discharge nip.

The now opened envelopes are fed from the envelope feeding device to an envelope conveyor where a continuous string of opened envelopes are shingled. The shingled, opened envelopes are fed from the envelope conveyor to the bottom of the opened envelope stack contained within the stacking device. The stacking device includes a photoeye that communicates with a control unit such that the control unit can control the operation of both the envelope conveyor and the envelope feeding device to feed envelopes to the stacking device as the height of the opened envelope stack decreases.

After the uppermost envelope in the opened envelope stack is stuffed with a document by the document insertion device, the envelope is lifted off of the stack by a suction device. The envelope is fed by a transfer device to an outfeed conveyor. While on the outfeed conveyor, the envelope flap is wetted and pressed into a closed position. The outfeed conveyor extends in a second direction that is different from the first direction of the document conveyor. From the outfeed conveyor, the closed envelopes are fed to conventional processing equipment, such as mailing and sorting machines.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings.

DETAILED DESCRIPTION OF THE INVENTION

Figures 1, 7:
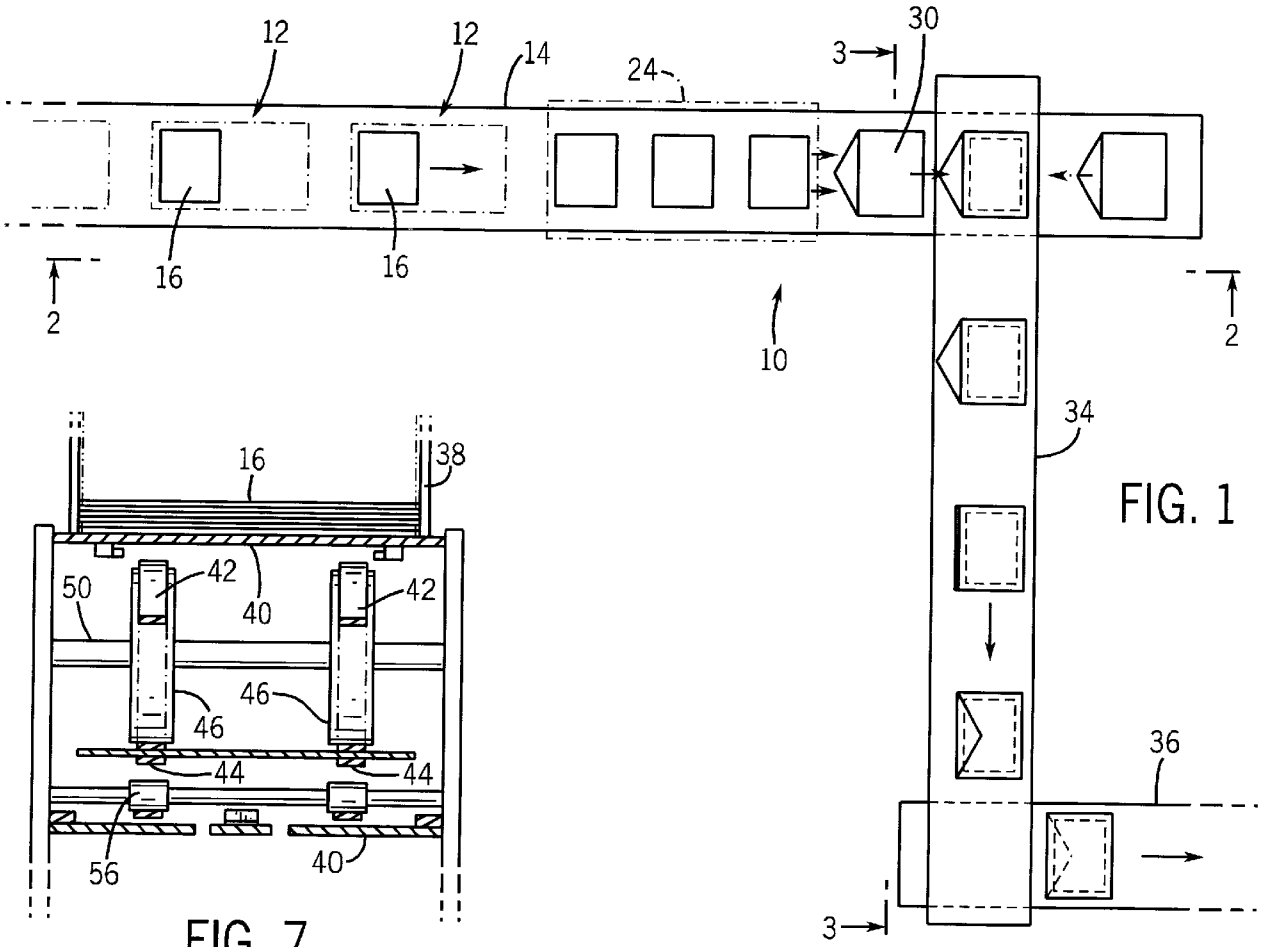
FIG. 1 is a schematic top plan view of a system for the automated insertion of documents into envelopes in accordance with the present invention.
FIG. 7 is a partial section view taken along line 7—7 of FIG. 6.
Figure 2:
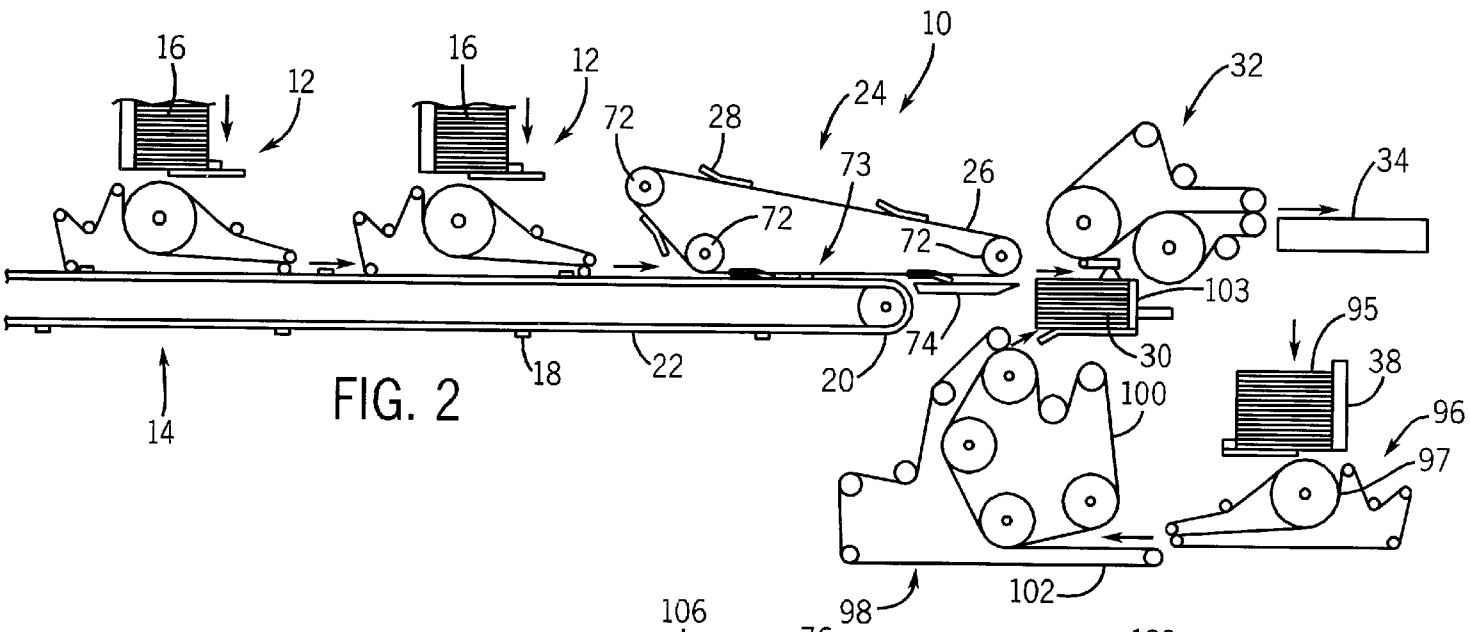
FIG. 2 is a side view of the system of the present invention as seen along line 2—2 of FIG. 1 further illustrating the operational components of the system.

The envelope inserter 10 of the present invention in schematically illustrated in FIG. 1 and shown in operational detail in FIG. 2. The envelope inserter 10 generally feeds articles or documents from individual stacks and stuffs the documents into individual envelopes, which are then sealed and distributed to a downstream processing system, such as a conventional mail addressing, stamping and sorting system.

The envelope inserter 10 of the present invention generally includes a plurality of document feeding devices 12 sequentially spaced along the longitudinal length of a documents conveyor 14. Each of the document feeding devices 12 includes a stack of documents 16 and operates to sequentially unload the stack of documents one by one onto the moving document conveyor 14. As can be understood in FIG. 1, the document conveyor 14 extends in a first direction along which the documents move. Although the present invention illustrates only two documents feeding devices 12 positioned along the length of the document conveyor 14, it is contemplated by the inventor that any number of document feeding devices 12 could be placed sequentially along the operative length of the document conveyor 14. The plurality of document feeding devices 12 can be configured to either dispense the same documents, or the document feeding devices 12 can each include a different document depending upon the selected user configuration for the envelope inserter 10.

As the documents 16 are dispensed onto the document conveyor 14, one of the spaced tabs 18 (FIG. 2) contacts the document and moves the document towards a discharge end 20 of the document conveyor. Each of the tabs 18 is spaced along the length of a rotating, endless chain 22 driven at a constant speed by a drive motor (not shown). In the preferred embodiment of the invention, the drive chain 22 is preferably driven at a speed such that approximately 100 envelopes per minute can be stuffed, although other speeds of operation are clearly within the scope of the present invention.

As the individual documents move along the document conveyor 14, the documents continue to move in the first direction until the documents reach a document insertion device 24. The document insertion device 24 generally includes a rotating, endless belt 26 that includes a plurality of spaced pusher members 28. As can best be seen in FIG. 2, the document insertion device 24 is positioned slightly above the document conveyor 14 and operates in-line with the document conveyor 14. The document insertion device 24 operates to accelerate the speed of each individual document 16 as it reaches the discharge end 20 of the document conveyor 14.

From the document insertion device 24, each individual document or stack of documents 16 is inserted into the topmost envelope of an accumulated opened envelope stack 30. Each envelope of the envelope stack 30 has been previously opened such that the documents can be readily fed into the envelope by the document insertion device 24.

After the top envelope of the opened envelope stack 30 has been loaded with the required document or documents, the stuffed envelope is transferred away from the stack 30 by a transfer device 32 to an outfeed conveyor 34, which then transfers the envelope to a sorting conveyor for further downstream processing. As can be understood in FIG. 1, the documents 16 travel in only the first direction until they are inserted into the top envelope of the opened envelope stack 30. After the envelope has been stuffed, the stuffed envelope is placed on the outfeed conveyor, which extends in a direction different from the first direction.

Although FIG. 1 is illustrated as including a single document conveyor 14, including a plurality of aligned document feeding devices 12 feeding stuffed envelopes onto the single outfeed conveyor 34, it is contemplated by the inventor that several document conveyors 14 could be aligned next to each other and operated to feed stuffed envelopes onto the single outfeed conveyor 34. The single outfeed conveyor 34 would then transfer the series of envelopes from the multiple document conveyors to the single sorting conveyor 36.

Figure 4:
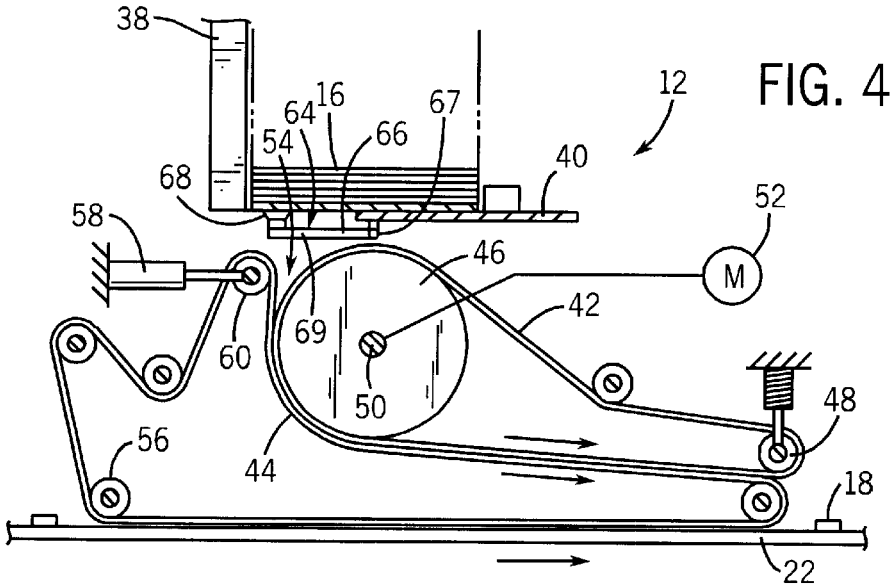
FIG. 4 is a detailed side view of a document feeding device that forms part of the system of the present invention.

Referring now to FIGS. 4–7, thereshown is the detailed construction of one the document feeding devices 12 that forms part of the envelope inserter 10 of the present invention. As can be seen in FIG. 4, the document feeding device 12 includes a stacking bin 38 that receives and supports a stack of documents 16. The stack of documents 16 can include either folded or unfolded material depending on the preference of the user. The stacking bin 38 includes a bottom support plate 40 that extends over a substantial portion of the width of each document 16.

Referring now to FIGS. 4 and 7, the document feeding device 12 includes a pair of spaced upper discharge belts 42 and a pair of spaced lower discharge belts 44. The upper discharge belts 42 are each a continuous belt entrained around one of the primary drive roller 46 and a discharge roller 48. As can be seen in FIG. 7, each of the primary drive rollers 46 is attached to a rotating drive shaft 50. The drive shaft 50, in turn, is connected to a drive motor 52. The operation of the drive motor 52, as well as the drive means for the document conveyor 14, are controlled by a central control unit (not shown).

The central control unit receives a signal from an encoder coupled to the drive shaft for the rotating, endless chain 22 of the document conveyor 14. The encoder generates a series of pulses as the drive shaft for the endless conveyor 14 rotates. By counting the number of pulses generated by the encoder, the central control unit can accurately monitor and determine the position of each of the tabs 18 along the length of the document conveyor 14. Based upon the position of the tabs, the central control unit can operate each of the document feeding devices 12 such that documents are dispensed from the accumulated stack at the right time to be received by one of the tabs 18 of the drive chain 22 that forms a part of the documents conveyor 14.

Through use of the encoder pulses generated by the drive motor for the document conveyor 14, the central control unit can accurately control the firing of each of the document feeding devices 12. If the envelope inserter 10 of the present invention is utilized with smaller documents that are being inserted into letter-sized envelopes, the number of tabs 18 on the endless chain 22 can be doubled and the firing of each document feeding device 12 also doubled. In this manner, a significantly larger number of envelopes can be loaded per minute without increasing the actual speed of the document conveyor 14.

As can be seen in FIG. 7, the drive rollers 46 and thus the upper discharge belts 42 are spaced along the width of the documents 16 contained within the stacking bin 38. As can be seen in FIGS. 4 and 7, the lower discharge belts 44 are directly aligned beneath the upper discharge belts 42 such that the upper discharge belts 42 and the lower discharge belts 44 form a discharge nip 54. The lower discharge belts 44 are entrained and supported by a series of individual rollers 56 such that a portion of each lower discharge belt 44 wraps around the primary drive roller 46 for the respective upper discharge belt 42. The speed of each lower discharge belts 44 is also controlled by the drive motor 52, such that the upper discharge belts 42 and the lower discharge belts 44 operate at substantially the same speed.

Figure 5:
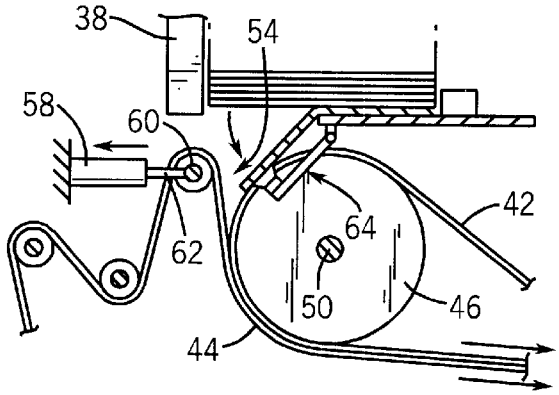
FIG. 5 is a partial side view similar to FIG. 4, further illustrating the operational steps of the document feeding device in discharging a document from the accumulated stack of documents.
Figure 6:
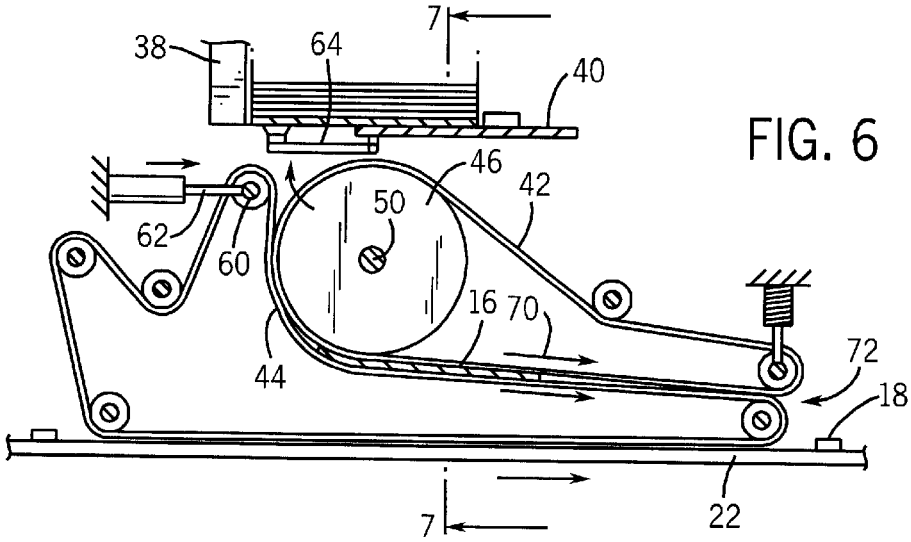
FIG. 6 is a further operational sequence diagram illustrating the document feeding device of the present invention.

As can be seen in FIGS. 4–6, the wrap angle of the lower discharge belts 44 along the primary drive roller 46 is controlled by a drive member 58 attached to a roller 60 about which the lower discharge belt 44 is entrained. When the drive member 58 is fully retracted, as shown in FIG. 5, the discharge nip 54 is effectively moved downward from the stacking bin 38. When the drive member 58 is extended, as sown in FIG. 6, the wrap angle increases such that discharge nip 54 moves upward toward the stacking bin 38, the significance of which will be made clear in the following discussion. In the preferred embodiment of the invention, the drive member 58 is an air cylinder having an extendable cylinder rod 62 attached to the roller 60, the operation of which is controlled by the central control unit.

Referring back the FIG. 4, the document feeding device 12 includes a suction device 64 rotatably positioned beneath the bottom support plate 40. The suction device 64 includes a support arm 66 having a first end 67 positioned beneath the bottom support plate 40 and having suction cup 68 attached to its outer end 69. The suction device 64 is connected to a supply of negative air pressure, such that a vacuum is created within the suction cup 68. The vacuum created in the suction cup 68 can be used to grasp the lowermost document 16 within the document stack in the stacking bin 38. As can be seen in FIGS. 4 and 5, the suction device 64 is moveable between the grasping position of FIG. 4 and the discharge position of FIG. 5. Although not shown in the drawings, the suction device 64 rotates further in the counter-clockwise direction from the position shown in FIG. 5 to a completely retracted position. When in the retracted position, the suction device 64 is moved away from the document 16 being discharged to prevent contact therewith. The movement of the suction drive 64 between the grasping position, the discharge position, and the retracted position is controlled by the control unit and is carried out by an air cylinder (not shown) coupled to the suction device 64.

In operation, the control unit for the envelope inserter 10 times the operation of each of the document feeding devices 12 to discharge individual documents 16 based upon the encoder pulses received from the drive shaft for the document conveyor 14. The sequence in which the document feeding devices 12 are operated depends upon whether each device 12 is unloading the same document 16 onto the discharge conveyor 14 or whether each device 12 is unloading different documents so that multiple articles can be inserted into a single envelope. If multiple articles are to be inserted into each element, each of the devices 12 is operated for each tab 18 such that multiple documents are moved along the document conveyor 14 by each tab 18.

Based upon the position of each tab 18, the drive member 58 retracts the cylinder rod 62 such that roller 60 is moved away from the primary drive roll 46 to decrease the wrap angle of the lower discharge belt 44 and move the discharge nip 54 away from the bottom of the stacking bin 38. At the same time, the source of negative air pressure is applied to the suction device 64 such that the suction cup 68 engages the lowermost document 16. Once the lowermost document 16 has been attracted to the suction cup 68, the suction device 64 is moved to its discharge position, as illustrated in FIG. 5. As can be seen in FIG. 5, when the suction device 64 is in the discharge position, the document 16 is pulled into contact with the rotating upper discharge belts 42.

Once the suction device 64 is in the discharged position, the source of negative air pressure is removed and the drive member 58 operated to extend the cylinder rod 62. As the cylinder rod 62 is extended, the lower discharge belts 44 entraps the document 16 between the upper discharge belts 42 and the lower discharge belts 44, as best illustrated in FIG. 6. As the document 16 is entrapped between the two sets of discharge belts, the suction device is rotated to the retracted position and the document is moved in the direction illustrated by arrows 70 and discharged from the discharged end 72 of the document feeding device 12 onto the moving document conveyor 14. After the lowermost document has been discharged, the suction device 64 returns to its engaged position for dispensing of the next document in the assembled stack, as illustrated in FIG. 6.

After the individual documents 16 have been dispensed by the respective document feeding devices 12, the documents 16 continue to proceed in the first direction along the document conveyor 14 until they come into contact with the document insertion device 24. As can be seen in FIG. 2, the document insertion device 24 operates in-line with and slightly above the document conveyor 14 in order to move the documents off of the document conveyor 14 and insert them into an envelope.

Figure 8:
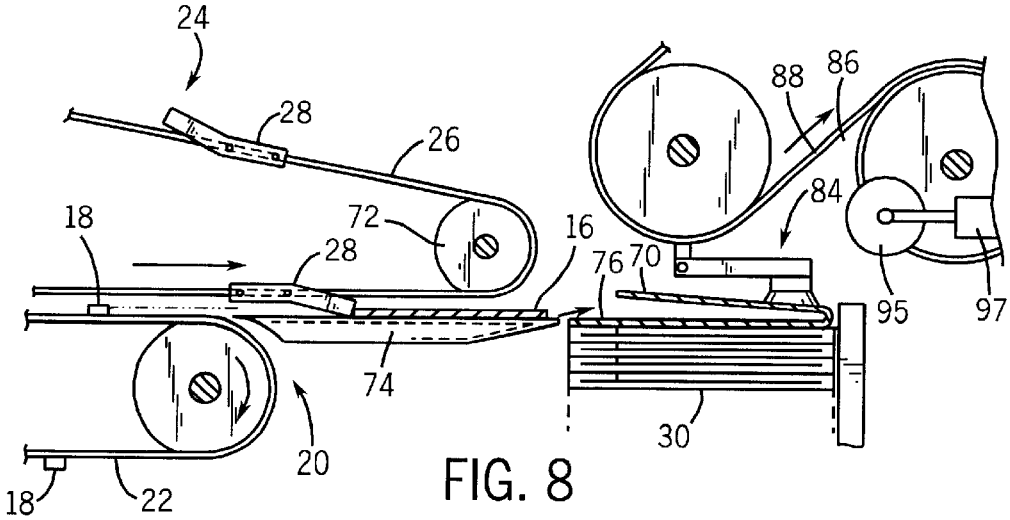
FIG. 8 is a partial side view of a document insertion device of the present invention, illustrating the loading of an individual document into an opened envelope.
Figure 9:
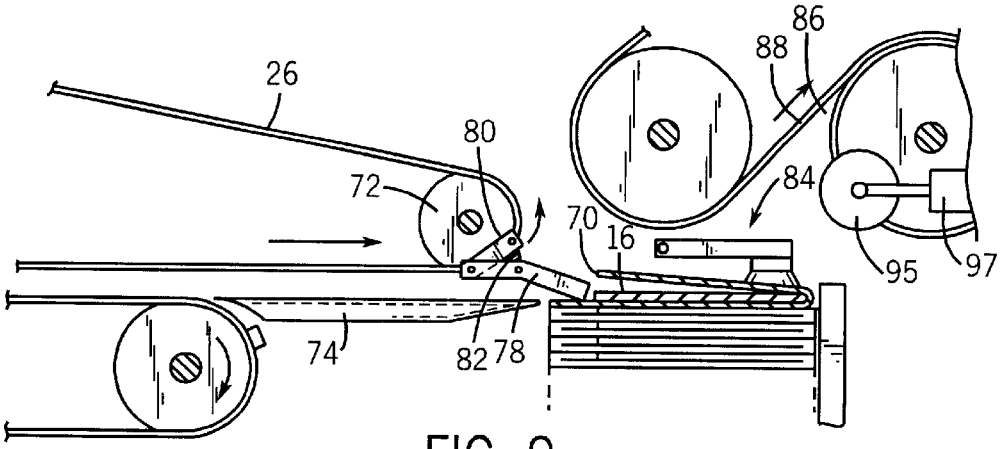
FIG. 9 is a further operational sequence diagram illustrating the insertion of a document into an opened envelope.
Figure 10:
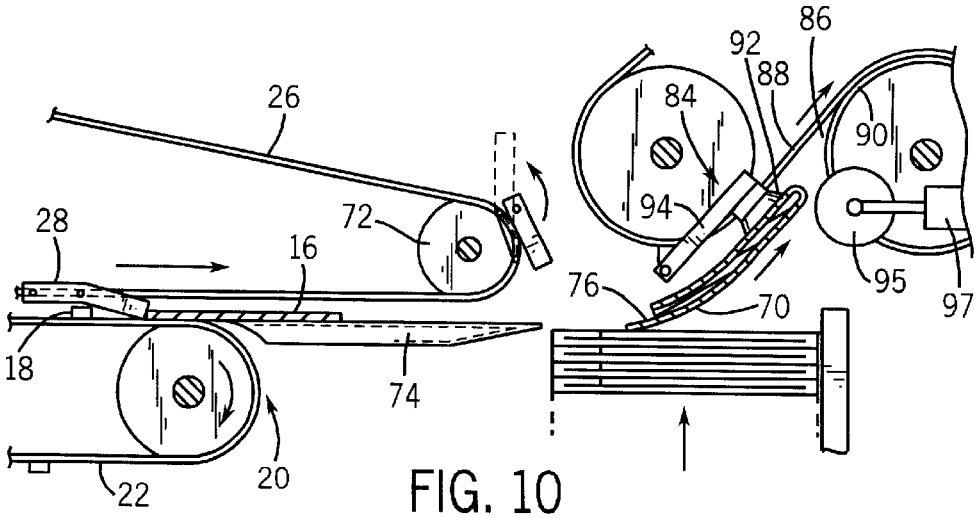
FIG. 10 is a operational sequence diagram illustrating the removal of a stuffed envelope from the stack of open envelopes accumulated near the discharge end of the document conveyor.

Referring now to FIGS. 8–10, thereshown are the operational details and steps performed by the document insertion device 24 for inserting one of the documents 16 into an opened envelope 70. As can be seen in FIGS. 2 and 8, the document insertion device 24 includes the continuous belt 26 entrained around a series of gears 72. The lowermost gears 72 define an operative path 73 for the continuous belt 26 that is parallel to the document conveyor 14 and spaced slightly above the document conveyor 14. In the preferred embodiment of the invention, the continuous belt 26 is operated slightly faster than the speed of the document conveyor 14 for reasons to be discussed below.

The continuous belt 26 includes a plurality of pusher members 28 that are spaced along the continuous length of the belt 26. The individual pusher members 28 are spaced from each other by a length that is slightly greater than the distance between the tabs 18 on the document conveyor 14 in order to compensate for the increased speed of the belt 26 relative to the speed of the document conveyor 14. The document insertion device 24 extends past the discharge end 20 of the document conveyor 14 such that the document insertion device 24 retains control of each of the documents 16 as the documents pass off of the discharge end 20 of the document conveyor 14.

As discussed previously, it is contemplated by the inventor that twice as many tabs 18 can be installed on the drive chain 22 of document conveyor 14 when the envelope insertion device 10 is used with small documents and letter sized envelopes to increase the rate at which envelopes are stuffed by the envelope insertion device 10. If the number of tabs 18 are increased on the document conveyor 14, the number of pusher members 28 spaced along the continuous length of the belt 26 also must be doubled. By doubling the number of tabs 18 and pusher members 28, the envelope insertion device 10 of the present invention can significantly increase the number of envelopes stuffed per minute without increasing the running speed of the document conveyor 14.

As an individual document passes beneath the document insertion device 24, one of the pusher members 28 contacts the trailing edge of the document 16, as illustrated in FIG. 8. Since the belt 26 of the document insertion device 24 is operated at a speed greater than the linear speed of the drive chain 22, the individual pusher member 28 accelerates the document 16 such that the document 16 is moved away from the individual tab 18 that was moving the document 16 along the document conveyor 14. As shown in FIG. 8, the pusher member 28 accelerates the document 16 such that a relatively significant amount of space exists between the trailing edge of the document 16 and the tab 18.

As the pusher member 28 accelerates the document and pushes the document from the discharge end 20 of the document conveyor 14, the document 16 is supported by a guide plate 74. The guide plate 74 is positioned next the envelope stack 30, which includes a series of individual envelopes 70 assembled such that the envelope flap 76 is positioned downward, as can be seen in FIG. 8. Although not shown, an air blast is used to open the uppermost envelope 70 as the document 16 is being pushed toward the envelope by the individual pusher member 28.

After the document 16 has been inserted into the uppermost envelope 70 by the pusher member 28, the pusher member 28 travels upward and around the downstream roller 72 and away from the now stuffed envelope. As can be seen in FIG. 9, the pusher member 28 of the present invention includes a pair of pusher fingers 78 connected to a support rail 80 by a spring member 82. The spring member 82 allows the pusher finger 78 to fully insert the document 16 into the open envelope 70 before the spring 82 snaps the fingers 78 upward, as illustrated in FIG. 10. As the pusher member 28 moves upward around the downstream gear 72, the spring 82 first moves the fingers 78 away from the envelope prior to the fingers 78 moving in the upward direction. In this manner, the pusher member 78 can fully insert the document 16 into the open envelope 70 and be subsequently moved away from the envelope to prevent damage to the envelope.

After the envelope has been stuffed with the document 16, a suction device 84 is operated to lift the stuffed envelope into contact with a discharge nip 86 between a pair of rotating belts 88 and 90. As can be seen in FIG. 10, the suction device 84 includes a suction cup 92 connected to a support arm 94. The support arm 94 is moveable between the grasping position of FIG. 9 and the discharge position of FIG. 10. When in the discharge position shown in FIG. 10, the stuffed envelope 70 is pressed into contact with the rotating belt 88 by a pinch roller 95. The pinch roller 95 is connected to a drive cylinder 97 that moves the pinch roller 95 toward and away from the belt 88. When the drive cylinder 97 is operated, the supply of negative air pressure to the suction cup 92 is terminated and the stuffed envelope 70 is caught within the discharge nip 86 between the pair of belts 88 and 90 and discharged from the envelope stack 30 for further downstream processing, as will be discussed in greater detail below.

Referring back to FIG. 2, the assembled stack of opened envelopes 30 is created as follows. Initially, a stack of unopened envelopes 95 is assembled within an envelope feeding device 96. Since the construction of the envelope feeding device 96 is identical to the construction of document feeding devices 12 discussed in detail above with reference being made to FIGS. 4–7, a complete description of the envelope feeding device 96 can be omitted. The stack of unopened envelopes 95 is positioned in the stacking bin 38 with the envelope flap 76 facing up and away from a discharge nip 97. As the lowermost envelope in the unopened envelope stack 95 is fed into the discharge nip 97, an air blast blows open the envelope flap such that lowermost envelope is fed into the discharge nip 97 in an opened condition.

From the envelope feeding device 96, the opened individual envelopes are fed to an envelope conveyor section 98. The envelope conveyor section 98 includes an upper conveyor belt 100 and a lower conveyor belt 102 operating at substantially the same speed. The individual envelopes are supported on the lower conveyor belt 102 and captured between the lower conveyor belt 102 and the upper belt 100. Both the upper conveyor belt 100 and the lower conveyor 102 are operated at a speed less than the discharge speed of the envelope feeding device 96 such that the envelopes fed from the envelope feeding device 96 are shingled within the envelope conveyor section 98.

The shingled envelopes pass through the envelope conveyor section 98 and are fed into the bottom of the stack of opened envelopes 30. The stack of opened envelopes 30 is accumulated within a stacking device 103 that is sized to adequately support the stack of opened envelopes 30. The stacking device 103 includes an open bottom that allows additional opened envelopes to be fed into the stack 30 by the envelope conveyor section 98. In the preferred embodiment of the invention, the stacking device 103 includes a photoeye that detects the height of the opened envelope stack 30. The operation of both envelope feeding device 96 and the envelop conveyor section 98 is controlled by the height of the stack of opened envelopes 30. As the height of the stack 30 decrease, both the envelope feeding device 96 and the envelope conveyor section 98 operates to supply additional envelopes to the stack 30.

Figure 3:
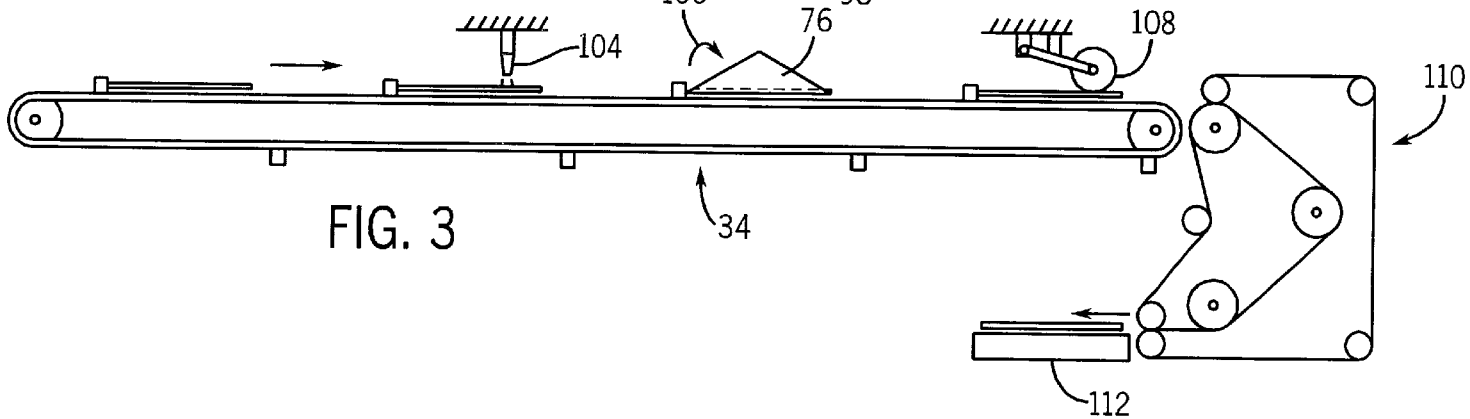
FIG. 3 is a side view of an outfeed conveyor portion of the system of the present invention, as viewed along line 3—3 of FIG. 1.

Referring now to FIG. 3, after each envelope has been stuffed with the required documents, the stuffed envelope is deposited onto the outfeed conveyor 34 by the transfer device 32. The position of the transfer device 32 relative to the document insertion device 24 can be adjusted to compensate for envelopes of differing sizes. When the transfer device 32 is moved either toward or away from the document insertion device 24, the upper and lower rotating belts 88 and 90 compensate for the movement and remain entrained around the series of rollers. In addition to the movement of the transfer device to compensate for the envelope size, the back support plate for the stacking device 103 is movable to adjust for the envelope size. In this manner, the envelope insertion device of the present invention can be easily configured to stuff envelopes of different sizes.

As can be seen in FIG. 1, the outfeed conveyor 34 extends in a second direction that is different from the first direction of the document conveyor 14. In the embodiment in the invention illustrated, the outfeed conveyor 34 extends at a right angle to the document conveyer 14. While each individual stuffed envelope is moved along the length of the outfeed conveyor 34, the glue on the envelope flap 76 is wetted by a spray nozzle 104. After the glue on the envelope flap 76 has been wetted by the spray nozzle 104, the envelope flap 76 is closed, as illustrated by arrow 106. After the envelope flap 76 is closed, a pressure roller 108 seals the envelope in a conventional manner.

After each envelope has been sealed, a second transfer conveyor system 110 transfers each individual envelope to a sorting a conveyor 112 where the individual stuffed envelopes can be processed downstream as desired. For example, the envelopes on the sorting conveyor 112 can be sorted in a conventional manner and postage applied as desired.

As previously discussed, the outfeed conveyor 34 is configured such that more than one document conveyor 14 can be aligned therewith. In this manner, the signal outfeed conveyor 34 can be used to accumulate stuffed envelopes from more than one source of documents.

Various alternatives and embodiments are contemplated as being within the scope of the following claims particularly pointing out and distinctly claiming the subject matter regarded as the invention.

I claim:

1. A system for the automated insertion of documents into envelopes, the system comprising:

at least one document conveyor extending between an infeed end and a discharge end, the document conveyor being operable to move documents in a first direction;

a plurality of document feeding devices spaced along the length of the document conveyor, each feeding device being operable to sequentially feed a single document from an accumulated stack of documents onto the document conveyor, each document feeding device comprising:

a stacking bin positioned to receive a stack of documents;

a suction device positioned beneath the stacking bin and movable between a grasping position and a discharge position wherein when the suction device is in the grasping position, a source of negative air pressure pulls the lowermost document of the stack into contact with the suction device;

a pair of rotating discharge belts positioned adjacent to each other to form a discharge nip, the discharge nip receiving the document from the suction device when the suction device is in the discharge position, the discharge belts transferring the document from the document feeding device to the document conveyor; and a drive member operable to adjust the position of the discharge nip, whereby the position of the discharge nip is adjustable to pull the document from the suction device when the suction device is in the discharge position;

an envelope feeding device holding a stack of unopened envelopes, the envelope feeding device being operable to individually discharge and open individual envelopes from the stack;

an envelope conveyor positioned to receive the opened envelopes from the envelope feeding device, wherein the envelope conveyor shingles the opened envelopes and accumulates the opened envelopes in an opened envelope stack at the discharge end of the document conveyor;

a document insertion device positioned at the discharge end of the document conveyor, the document insertion device including a plurality of pusher members moving in the first direction at a speed greater than the speed of the document conveyor such that the pusher members push the documents from the document conveyor into the uppermost envelope of the opened envelope stack; and an outfeed conveyor positioned to receive the envelopes including the inserted document, the outfeed conveyor extending in a second direction different from the first direction to transport the envelopes away from the document conveyor.

2. The system of claim 1 wherein the document insertion device includes a continuous belt having a plurality of spaced pusher members, the continuous belt extending in the first direction and being positioned above the document conveyor, the continuous belt being driven at a speed greater than the speed of the document conveyor.

3. The system of claim 1 wherein the envelope conveyor further includes a stacking device positioned to accumulate the opened envelopes in a stack and a discharge device to remove the top envelope from the opened envelope stack after a document has been loaded therein, the discharge device being connected to a supply of negative air pressure and being movable between a grasping position and a discharge position.

4. The system of claim 1 wherein the discharge belts and the document conveyor operate at substantially the same speed.

5. The system of claim 1 wherein the movement of the suction device is controlled by an air cylinder.

6. The system of claim 5 wherein the drive member operable to adjust the position of the discharge nip is an air cylinder.

7. The system of claim 1 wherein the document feeding devices feed different documents such that multiple documents can be inserted into the same envelope.

8. The system of claim 1 wherein the envelope feeding device comprises:

a stacking bin positioned to receive a stack of unopened envelopes;

a suction device positioned beneath the stacking bin and movable between a grasping position and a discharge position wherein when the suction device is in the grasping position, a source of negative air pressure pulls the lowermost envelope of the stack into contact with the suction device; and a pair of rotating discharge belts positioned adjacent to each other to form a discharge nip, the discharge nip receiving the envelope from the suction device when the suction device is in the discharge position, the discharge belts transferring the envelope from the envelope feeding device to the envelope conveyor.

9. The system of claim 8 wherein the envelope feeding device includes an air nozzle that directs a blast of air into contact with the unopened envelope as the unopened envelope is transferred into contact with the discharge nip such that the envelope feeding device opens the envelope flap prior to the transfer of the envelope from the stacking bin to the envelope conveyor.

* * * * *